US008111209B2

(12) United States Patent
Chui

(10) Patent No.: US 8,111,209 B2
(45) Date of Patent: Feb. 7, 2012

(54) COMPOSITE DISPLAY

(75) Inventor: Clarence Chui, San Jose, CA (US)

(73) Assignee: Qualcomm Mems Technologies, Inc., San Diego, CA (US)

( * ) Notice: Subject to any disclaimer, the term of this patent is extended or adjusted under 35 U.S.C. 154(b) by 855 days.

(21) Appl. No.: 11/906,770

(22) Filed: Oct. 2, 2007

(65) Prior Publication Data

US 2009/0002270 A1 Jan. 1, 2009

Related U.S. Application Data

(60) Provisional application No. 60/966,549, filed on Jun. 28, 2007.

(51) Int. Cl.

| | |
|---|---|
| ***G09G 3/00*** | (2006.01) |
| ***G09G 3/06*** | (2006.01) |
| ***F21V 21/30*** | (2006.01) |
| ***F21V 21/26*** | (2006.01) |

(52) U.S. Cl. ..... 345/31; 345/30; 345/44; 345/46; 362/35; 362/272

(58) Field of Classification Search ..... None
See application file for complete search history.

(56) References Cited

U.S. PATENT DOCUMENTS

| | | | |
|---|---|---|---|
| 1,725,851 | A | 8/1929 | Craig |
| 2,036,147 | A | 3/1936 | Klema |
| 2,951,617 | A | 9/1960 | Brock |
| 3,246,410 | A | 4/1966 | Festa |
| 3,465,586 | A | 9/1969 | Johnston |
| 4,160,973 | A | 7/1979 | Berlin, Jr. |
| 4,298,868 | A | 11/1981 | Spurgeon |
| 4,311,999 | A | 1/1982 | Upton et al. |
| 4,689,604 | A | 8/1987 | Sokol |
| 5,057,827 | A | 10/1991 | Nobile et al. |

(Continued)

FOREIGN PATENT DOCUMENTS

| | | |
|---|---|---|
| CN | 102187679 | 9/2011 |

(Continued)

OTHER PUBLICATIONS

An Analog & Digital propeller clock I made! It isn't Real its just because your so awfully slow!!!;-) 1997 Bob Blick pp. 1-26 http://www.luberth.com/analog.htm.

(Continued)

*Primary Examiner* — Richard Hjerpe
*Assistant Examiner* — Alecia D English
(74) *Attorney, Agent, or Firm* — Weaver Austin Villeneuve & Sampson LLP

(57) ABSTRACT

A composite display is disclosed. A first paddle has a first plurality of pixel elements wherein the first paddle is arranged to sweep out a first area during a first paddle cycle. A second paddle has a second plurality of pixel elements wherein the second paddle is arranged to sweep out a second area during a second paddle cycle and wherein the first and second areas include first and second nonoverlapping portions. A first pixel element on the first paddle is configured to be activated when the first pixel element coincides with a first image pixel. A second pixel element on the second paddle is configured to be activated when the second pixel element coincides with a second image pixel. An image corresponding to the first and second image pixels is represented on the composite display by activating the first and second pixel elements.

36 Claims, 14 Drawing Sheets

U.S. PATENT DOCUMENTS 5,101,439 A 3/1992 Kiang
5,115,229 A 5/1992 Shalit
5,190,491 A 3/1993 Connelly
5,444,456 A 8/1995 Ohta et al.
5,576,761 A 11/1996 Iwamoto
5,717,416 A * 2/1998 Chakrabarti ..... 345/31
5,748,157 A 5/1998 Eason
5,791,966 A 8/1998 Capps et al.
5,800,039 A 9/1998 Lee
5,864,331 A 1/1999 Anand et al.
5,886,728 A 3/1999 Hamada et al.
5,959,617 A 9/1999 Bird et al.
5,990,498 A 11/1999 Chapnik et al.
5,992,498 A 11/1999 Boston
6,037,876 A 3/2000 Crouch
6,116,762 A 9/2000 Kutlucinar
6,193,384 B1 2/2001 Stein
6,243,059 B1 6/2001 Greene et al.
6,243,149 B1 6/2001 Swanson et al.
6,249,998 B1 * 6/2001 NakaMats ..... 40/452
6,265,984 B1 7/2001 Molinaroli
6,275,615 B1 8/2001 Ida et al.
6,320,325 B1 11/2001 Cok et al.
6,404,409 B1 6/2002 Solomon
6,475,153 B1 11/2002 Khair et al.
6,492,963 B1 12/2002 Hoch
6,508,022 B2 1/2003 Huang
6,525,668 B1 2/2003 Petrick
6,575,585 B2 6/2003 Nelson et al.
6,697,034 B2 2/2004 Tashman
6,856,303 B2 2/2005 Kowalewski
6,928,137 B2 8/2005 Bruder et al.
6,955,449 B2 10/2005 Martineau
7,027,054 B1 4/2006 Cheiky et al.
7,033,035 B2 4/2006 Fatemi et al.
7,082,591 B2 7/2006 Carlson
7,101,153 B2 9/2006 Cartwright
7,113,165 B2 9/2006 Vincent et al.
7,164,810 B2 1/2007 Schnee et al.
7,175,305 B2 2/2007 Martineau
7,237,924 B2 7/2007 Martineau et al.
7,267,444 B2 9/2007 Black, Jr.
7,271,813 B2 9/2007 Gilbert
7,397,387 B2 7/2008 Suzuki et al.
7,553,051 B2 6/2009 Brass et al.
7,703,946 B2 4/2010 Chiang et al.
7,714,923 B2 5/2010 Cok et al.
7,758,214 B2 7/2010 Lee et al.
7,837,358 B2 11/2010 Liao
7,871,192 B2 1/2011 Chien
7,872,631 B2 1/2011 Feng et al.
7,911,411 B2 3/2011 Yoshikawa et al.
2001/0023547 A1 9/2001 Huang
2001/0048406 A1 12/2001 Masumoto et al.
2002/0005826 A1 * 1/2002 Pederson ..... 345/82
2002/0140631 A1 10/2002 Blundell
2002/0176625 A1 11/2002 Porikli et al.
2003/0160739 A1 8/2003 Silic
2003/0164807 A1 9/2003 Glatzer
2003/0184513 A1 10/2003 Janssen
2003/0218881 A1 11/2003 Hansen et al.
2004/0102223 A1 5/2004 Lo et al.
2004/0105256 A1 6/2004 Jones
2004/0105573 A1 6/2004 Neumann et al.
2004/0114714 A1 6/2004 Minyard et al.
2004/0140981 A1 7/2004 Clark
2004/0141581 A1 7/2004 Bruder et al.
2004/0188687 A1 9/2004 Arnold et al.
2004/0196225 A1 10/2004 Shimada
2004/0262393 A1 12/2004 Hara et al.
2005/0030305 A1 2/2005 Brown et al.
2005/0052404 A1 3/2005 Kim et al.
2005/0110728 A1 5/2005 Cok
2005/0174780 A1 8/2005 Park
2005/0237272 A1 10/2005 Josephson et al.
2005/0264472 A1 * 12/2005 Rast ..... 345/30
2006/0001384 A1 1/2006 Tain et al.
2006/0006524 A1 1/2006 Hsieh
2006/0007011 A1 1/2006 Chivarov
2006/0007206 A1 1/2006 Reddy et al.
2006/0038831 A1 2/2006 Gilbert
2006/0081869 A1 4/2006 Lu et al.
2006/0092639 A1 5/2006 Livesay et al.
2006/0119592 A1 6/2006 Wang et al.
2006/0152524 A1 7/2006 Miller et al.
2006/0244741 A1 11/2006 Kimura et al.
2006/0274286 A1 12/2006 Morejon et al.
2007/0035707 A1 2/2007 Margulis
2007/0046924 A1 3/2007 Chang
2007/0177817 A1 8/2007 Szeliski et al.
2008/0062161 A1 3/2008 Brown
2008/0068297 A1 3/2008 Gilbert
2008/0068799 A1 3/2008 Chan
2008/0106628 A1 5/2008 Cok et al.
2008/0222932 A1 9/2008 Yun et al.
2008/0253125 A1 10/2008 Kang et al.
2008/0303747 A1 12/2008 Velicescu
2009/0002271 A1 1/2009 Chui
2009/0002272 A1 1/2009 Chui
2009/0002273 A1 1/2009 Chui
2009/0002288 A1 1/2009 Chui
2009/0002289 A1 1/2009 Chui
2009/0002290 A1 1/2009 Chui
2009/0002293 A1 1/2009 Chui
2009/0002362 A1 1/2009 Chui
2009/0104969 A1 4/2009 Paulsen et al.
2009/0115794 A1 5/2009 Fukuta
2009/0323341 A1 12/2009 Chui
2010/0019993 A1 1/2010 Chui
2010/0019997 A1 1/2010 Chui
2010/0020107 A1 1/2010 Chui
2010/0097448 A1 4/2010 Gilbert et al.
2010/0301372 A1 12/2010 Loh

FOREIGN PATENT DOCUMENTS

DE 102006030890 5/2007
EP 1335430 8/2003
EP 2167999 3/2010
EP 2342899 7/2011
EP 2390867 11/2011
EP 2395499 12/2011
JP 2006-252777 9/2006
TW 2009017179 4/2009
WO 00/17843 3/2000
WO 03/021565 3/2003
WO 03/077013 9/2003
WO 2004/097783 11/2004
WO WO2006/021788 * 3/2006
WO 2009005754 1/2009
WO 2009005756 1/2009
WO 2009005757 1/2009
WO 2009005762 1/2009
WO 2010011303 1/2010

OTHER PUBLICATIONS

SpaceWriter, Lighting Kinetics, FanScreen, Jul. 25, 2002: http://web.archive.org/web/20020725092751/http:/www.spacewriter.com/.

SpaceWriter, WallScreen, Dec. 7, 2003: http://web.archive.org/web/20031207125205/www.spacewriter.com/wallscreen.asp?menuproduct=WS.

U.S. Office Action mailed Sep. 28, 2010, from U.S. Appl. No. 11/906,772.

U.S. Office Action mailed Sep. 23, 2010, from U.S. Appl. No. 11/906,773.

U.S. Office Action mailed Sep. 28, 2010, from U.S. Appl. No. 11/906,774.

U.S. Office Action mailed Sep. 3, 2010, from U.S. Appl. No. 11/906,775.

U.S. Office Action mailed Jan. 31, 2011, from U.S. Appl. No. 12/008,700.

U.S. Office Action mailed Feb. 9, 2011, from U.S. Appl. No. 12/008,711.

U.S. Office Action mailed Feb. 14, 2011, from U.S. Appl. No. 12/008,712.

U.S. Office Action mailed Dec. 6, 2010, from U.S. Appl. No. 12/099,843.
International Search Report and Written Opinion mailed Oct. 7, 2008, from Application No. PCT/US2008/008111.
International Preliminary Report on Patentability mailed Jan. 5, 2010, from Application No. PCT/US2008/008111.
International Search Report and Written Opinion mailed Sep. 29, 2008, from Application No. PCT/US2008/008102.
International Preliminary Report on Patentability mailed Jan. 5, 2010, from Application No. PCT/US2008/008102.
International Search Report and Written Opinion mailed Oct. 7, 2008, from Application No. PCT/US2008/008106.
International Preliminary Report on Patentability mailed Jan. 5, 2010, from Application No. PCT/US2008/008106.
International Search Report and Written Opinion mailed Oct. 1, 2008, from Application No. PCT/US2008/008098.
International Preliminary Report on Patentability mailed Jan. 5, 2010, from Application No. PCT/US2008/008098.
International Search Report and Written Opinion mailed Nov. 16, 2009, from Application No. PCT/US2009/004245.
International Preliminary Report on Patentability mailed Jan. 25, 2011, from Application No. PCT/US2009/004245.
U.S. Final Office Action mailed Apr. 12, 2011, from U.S. Appl. No. 11/906,772.
U.S. Final Office Action mailed Apr. 26, 2011, from U.S. Appl. No. 11/906,773.
U.S. Final Office Action mailed Mar. 29, 2011, from U.S. Appl. No. 11/906,774.
U.S. Final Office Action mailed May 12, 2011, from U.S. Appl. No. 11/906,775.
U.S. Office Action mailed Jun. 2, 2011, from U.S. Appl. No. 12/008,700.
U.S. Final Office Action mailed Jun. 2, 2011, from U.S. Appl. No. 12/008,711.
U.S. Final Office Action mailed Jun. 15, 2011, from U.S. Appl. No. 12/008,712.
U.S. Notice of Allowance mailed May 31, 2011, from U.S. Appl. No. 12/009,843.
U.S. Office Action mailed Jul. 5, 2011, from U.S. Appl. No. 12/099,843.
U.S. Office Action mailed May 26, 2011, from U.S. Appl. No. 12/220,443.
U.S. Office Action mailed Jun. 15, 2011, from U.S. Appl. No. 12/220,444.
U.S. Office Action mailed Jun. 9, 2011, from U.S. Appl. No. 12/220,443.
U.S. Office Action mailed Apr. 4, 2011, from U.S. Appl. No. 12/380,588.
U.S. Office Action mailed Oct. 13, 2011, from U.S. Appl. No. 11/906,774.
U.S. Advisory Action mailed Jul. 26, 2011, from U.S. Appl. No. 11/906,775.
U.S. Notice of Allowance mailed Oct. 20, 2011, from U.S. Appl. No. 12/008,700.
U.S. Notice of Allowance mailed Oct. 19, 2011, from U.S. Appl. No. 12/008,711.
U.S. Office Action mailed Sep. 29, 2011, from U.S. Appl. No. 12/008,712.
U.S. Final Office Action mailed Oct. 24, 2011, from U.S. Appl. No. 12/220,443.
U.S. Final Office Action mailed Oct. 21, 2011, from U.S. Appl. No. 12/220,444.
U.S. Final Office Action mailed Oct. 17, 2011, from U.S. Appl. No. 12/220,447.
U.S. Final Office Action mailed Aug. 22, 2011, from U.S. Appl. No. 12/380,588.
European Extended Search Report mailed Nov. 15, 2011, from Application No. 11164990.1-2205
European Extended Search Report mailed Nov. 2, 2011, from Application No. 11164973.7-2205.

* cited by examiner

COMPOSITE DISPLAY

CROSS REFERENCE TO OTHER APPLICATIONS

This application claims priority to U.S. Provisional Patent Application No. 60/966,549 entitled COMPOSITE DISPLAY filed Jun. 28, 2007, which application is incorporated herein by reference for all purposes.

BACKGROUND OF THE INVENTION

Digital displays are used to display images or video to provide advertising or other information. For example, digital displays may be used in billboards, bulletins, posters, highway signs, and stadium displays. Digital displays that use liquid crystal display (LCD) or plasma technologies are limited in size because of size limits of the glass panels associated with these technologies. Larger digital displays typically comprise a grid of printed circuit board (PCB) tiles, where each tile is populated with packaged light emitting diodes (LEDs). Because of the space required by the LEDs, the resolution of these displays is relatively coarse. Also, each LED corresponds to a pixel in the image, which can be expensive for large displays. In addition, a complex cooling system is typically used to sink heat generated by the LEDs, which may burn out at high temperatures. As such, improvements to digital display technology are needed.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process, an apparatus, a system, a composition of matter, a computer readable medium such as a computer readable storage medium or a computer network wherein program instructions are sent over optical or communication links. In this specification, these implementations, or any other form that the invention may take, may be referred to as techniques. A component such as a processor or a memory described as being configured to perform a task includes both a general component that is temporarily configured to perform the task at a given time or a specific component that is manufactured to perform the task. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Figure 1:
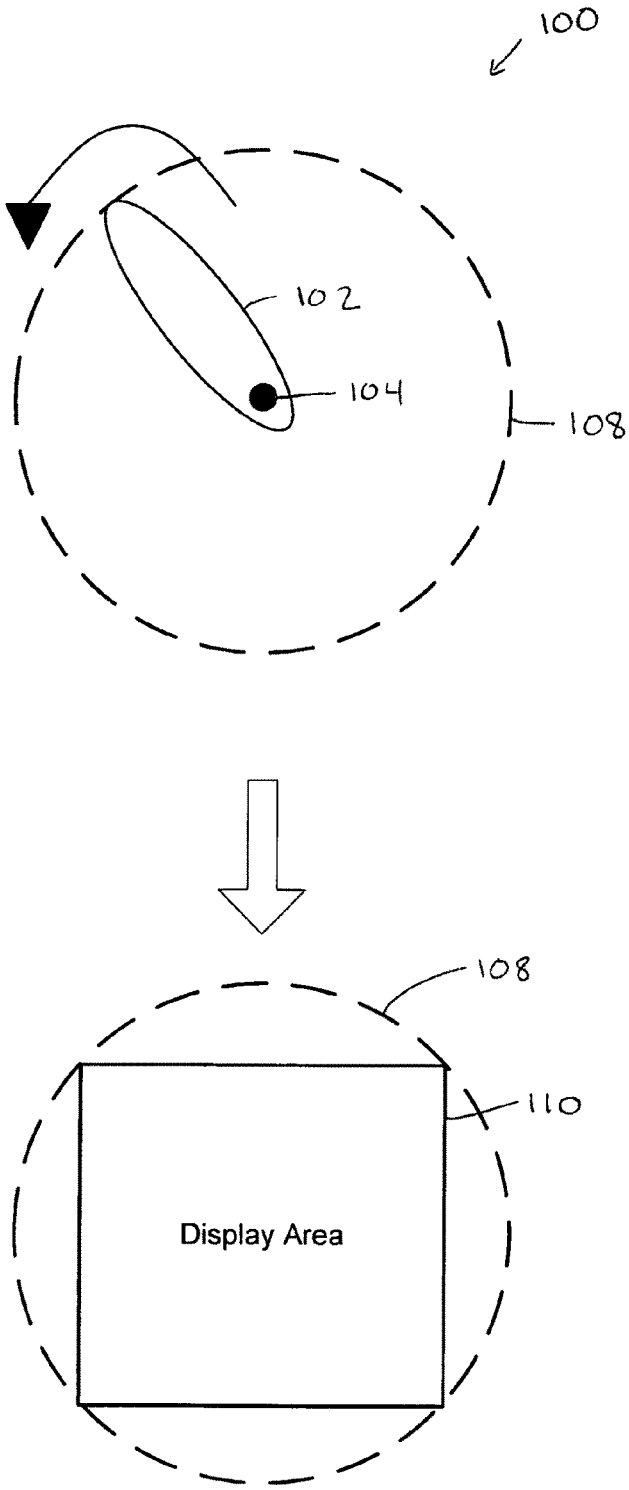
FIG. 1 is a diagram illustrating an embodiment of a composite display 100 having a single paddle.

FIG. 1 is a diagram illustrating an embodiment of a composite display 100 having a single paddle. In the example shown, paddle 102 is configured to rotate at one end about axis of rotation 104 at a given frequency, such as 60 Hz. Paddle 102 sweeps out area 108 during one rotation or paddle cycle. A plurality of pixel elements, such as LEDs, is installed on paddle 102. As used herein, a pixel element refers to any element that may be used to display at least a portion of image information. As used herein, image or image information may include image, video, animation, slideshow, or any other visual information that may be displayed. Other examples of pixel elements include: laser diodes, phosphors, cathode ray tubes, liquid crystal, any transmissive or emissive optical modulator. Although LEDs may be described in the examples herein, any appropriate pixel elements may be used. In various embodiments, LEDS may be arranged on paddle 102 in a variety of ways, as more fully described below.

As paddle 102 sweeps out area 108, one or more of its LEDs are activated at appropriate times such that an image or a part thereof is perceived by a viewer who is viewing swept area 108. An image is comprised of pixels each having a spatial location. It can be determined at which spatial location a particular LED is at any given point in time. As paddle 102 rotates, each LED can be activated as appropriate when its location coincides with a spatial location of a pixel in the image. If paddle 102 is spinning fast enough, the eye perceives a continuous image. This is because the eye has a poor frequency response to luminance and color information. The eye integrates color that it sees within a certain time window. If a few images are flashed in a fast sequence, the eye integrates that into a single continuous image. This low temporal sensitivity of the eye is referred to as persistence of vision.

As such, each LED on paddle 102 can be used to display multiple pixels in an image. A single pixel in an image is mapped to at least one "temporal pixel" in the display area in composite display 100. A temporal pixel can be defined by a pixel element on paddle 102 and a time (or angular position of the paddle), as more fully described below.

The display area for showing the image or video may have any shape. For example, the maximum display area is circular and is the same as swept area 108. A rectangular image or video may be displayed within swept area 108 in a rectangular display area 110 as shown.

Figure 2A:
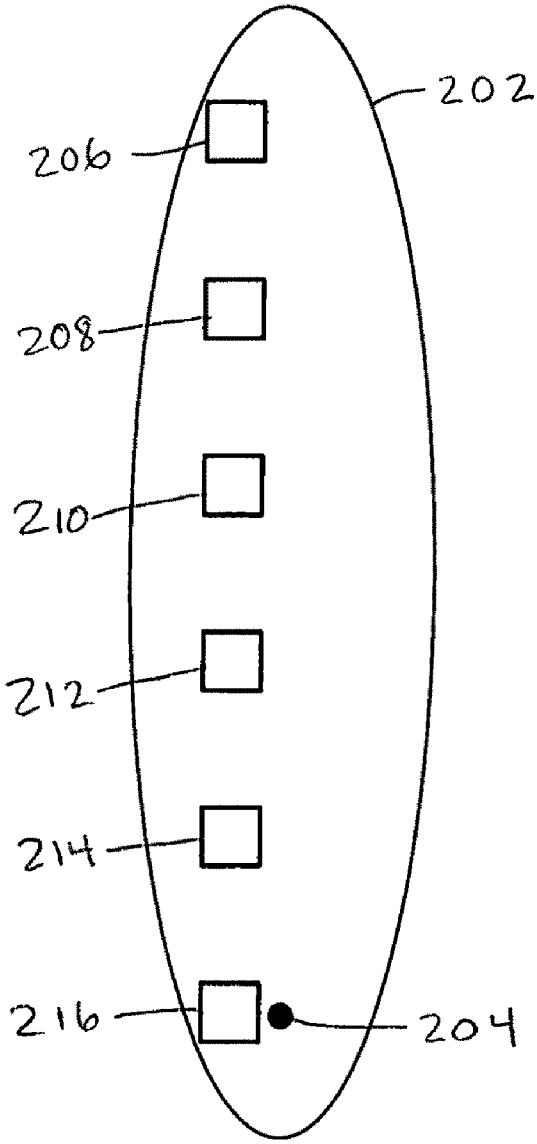
FIG. 2A is a diagram illustrating an embodiment of a paddle used in a composite display.

FIG. 2A is a diagram illustrating an embodiment of a paddle used in a composite display. For example, paddle 202, 302, or 312 (discussed later) may be similar to paddle 102. Paddle 202 is shown to include a plurality of LEDs 206-216 and an axis of rotation 204 about which paddle 202 rotates. LEDs 206-216 may be arranged in any appropriate way in various embodiments. In this example, LEDs 206-216 are arranged such that they are evenly spaced from each other and aligned along the length of paddle 202. They are aligned on the edge of paddle 202 so that LED 216 is adjacent to axis of rotation 204. This is so that as paddle 202 rotates, there is no blank spot in the middle (around axis of rotation 204). In some embodiments, paddle 202 is a PCB shaped like a paddle. In some embodiments, paddle 202 has an aluminum, metal, or other material casing for reinforcement.

Figure 2B:
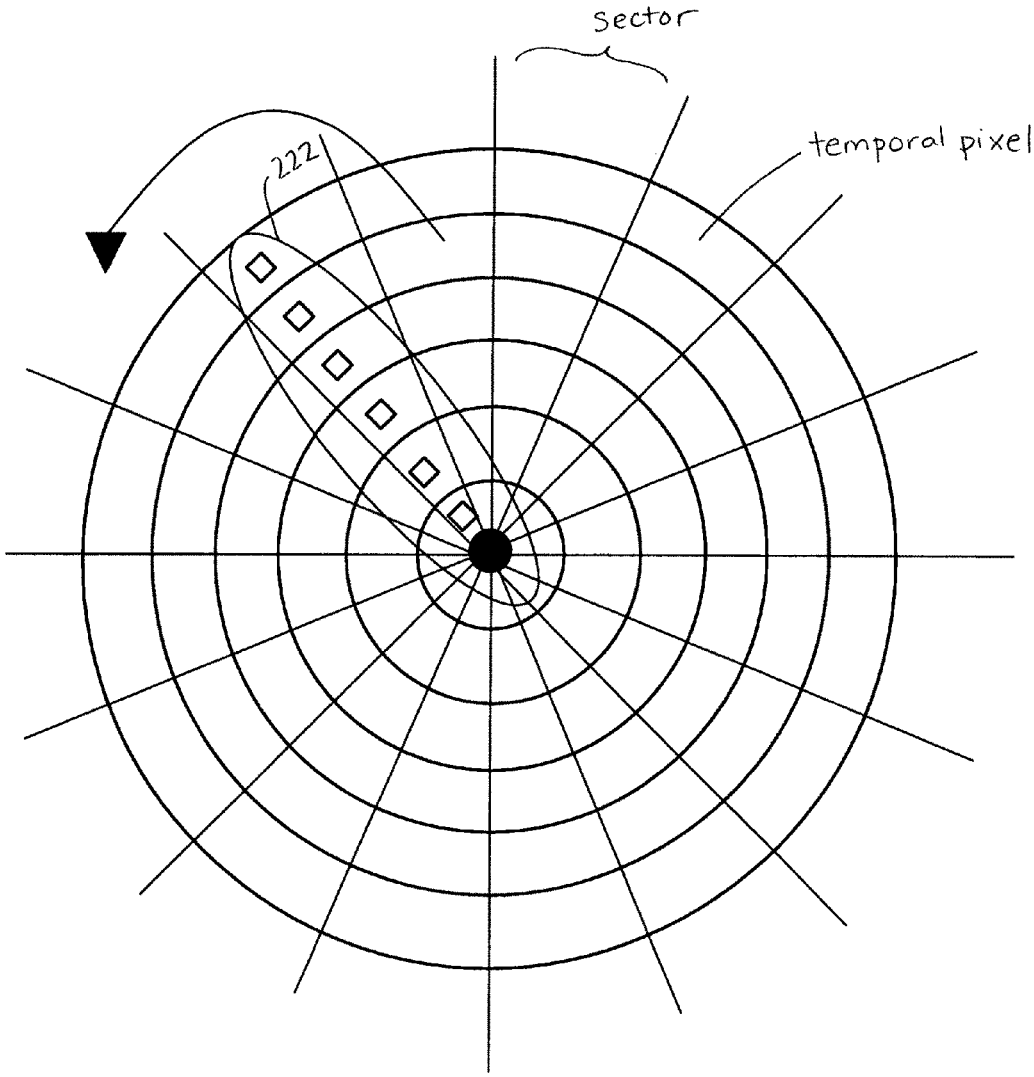
FIG. 2B illustrates an example of temporal pixels in a sweep plane.

FIG. 2B illustrates an example of temporal pixels in a sweep plane. In this example, each LED on paddle 222 is associated with an annulus (area between two circles) around the axis of rotation. Each LED can be activated once per sector (angular interval). Activating an LED may include, for example, turning on the LED for a prescribed time period (e.g., associated with a duty cycle) or turning off the LED. The intersections of the concentric circles and sectors form areas that correspond to temporal pixels. In this example, each temporal pixel has an angle of 42.5 degrees, so that there are a total of 16 sectors during which an LED may be turned on to indicate a pixel. Because there are 6 LEDs, there are 6*16=96 temporal pixels. In another example, a temporal pixel may have an angle of 1/10 of a degree, so that there are a total of 3600 angular positions possible.

Because the spacing of the LEDs along the paddle is uniform in the given example, temporal pixels get denser towards the center of the display (near the axis of rotation). Because image pixels are defined based on a rectangular coordinate system, if an image is overlaid on the display, one image pixel may correspond to multiple temporal pixels close to the center of the display. Conversely, at the outermost portion of the display, one image pixel may correspond to one or a fraction of a temporal pixel. For example, two or more image pixels may fit within a single temporal pixel. In some embodiments, the display is designed (e.g., by varying the sector time or the number/placement of LEDs on the paddle) so that at the outermost portion of the display, there is at least one temporal pixel per image pixel. This is to retain in the display the same level of resolution as the image. In some embodiments, the sector size is limited by how quickly LED control data can be transmitted to an LED driver to activate LED(s). In some embodiments, the arrangement of LEDs on the paddle is used to make the density of temporal pixels more uniform across the display. For example, LEDs may be placed closer together on the paddle the farther they are from the axis of rotation.

Figure 3:
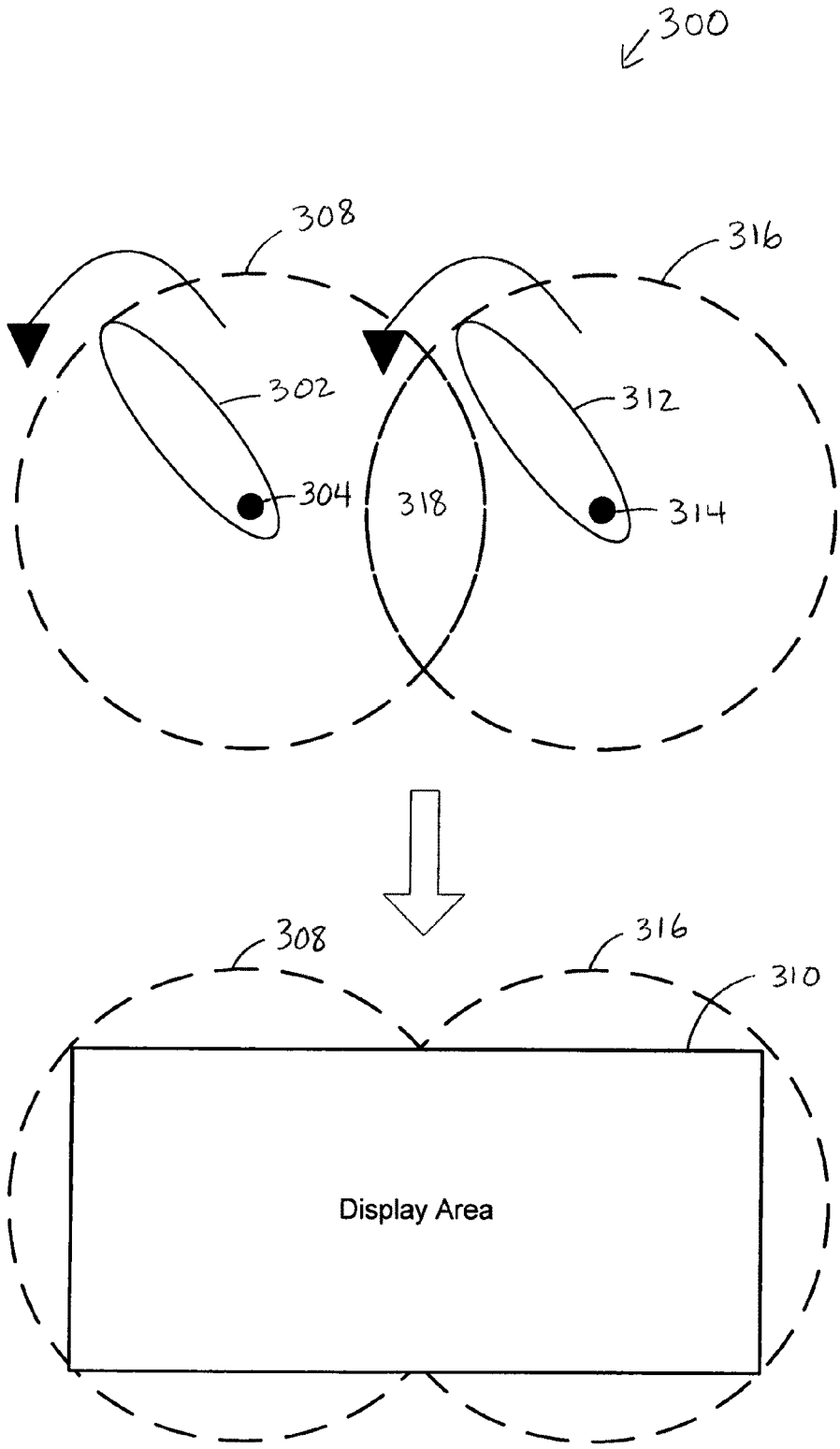
FIG. 3 is a diagram illustrating an embodiment of a composite display 300 having two paddles.

FIG. 3 is a diagram illustrating an embodiment of a composite display 300 having two paddles. In the example shown, paddle 302 is configured to rotate at one end about axis of rotation 304 at a given frequency, such as 60 Hz. Paddle 302 sweeps out area 308 during one rotation or paddle cycle. A plurality of pixel elements, such as LEDs, is installed on paddle 302. Paddle 312 is configured to rotate at one end about axis of rotation 314 at a given frequency, such as 60 Hz. Paddle 312 sweeps out area 316 during one rotation or paddle cycle. A plurality of pixel elements, such as LEDs, is installed on paddle 312. Swept areas 308 and 316 have an overlapping portion 318.

Using more than one paddle in a composite display may be desirable in order to make a larger display. For each paddle, it can be determined at which spatial location a particular LED is at any given point in time, so any image can be represented by a multiple paddle display in a manner similar to that described with respect to FIG. 1. In some embodiments, for overlapping portion 318, there will be twice as many LEDs passing through per cycle than in the nonoverlapping portions. This may make the overlapping portion of the display appear to the eye to have higher luminance. Therefore, in some embodiments, when an LED is in an overlapping portion, it may be activated half the time so that the whole display area appears to have the same luminance. This and other examples of handling overlapping areas are more fully described below.

The display area for showing the image or video may have any shape. The union of swept areas 308 and 316 is the maximum display area. A rectangular image or video may be displayed in rectangular display area 310 as shown.

Figure 4A:
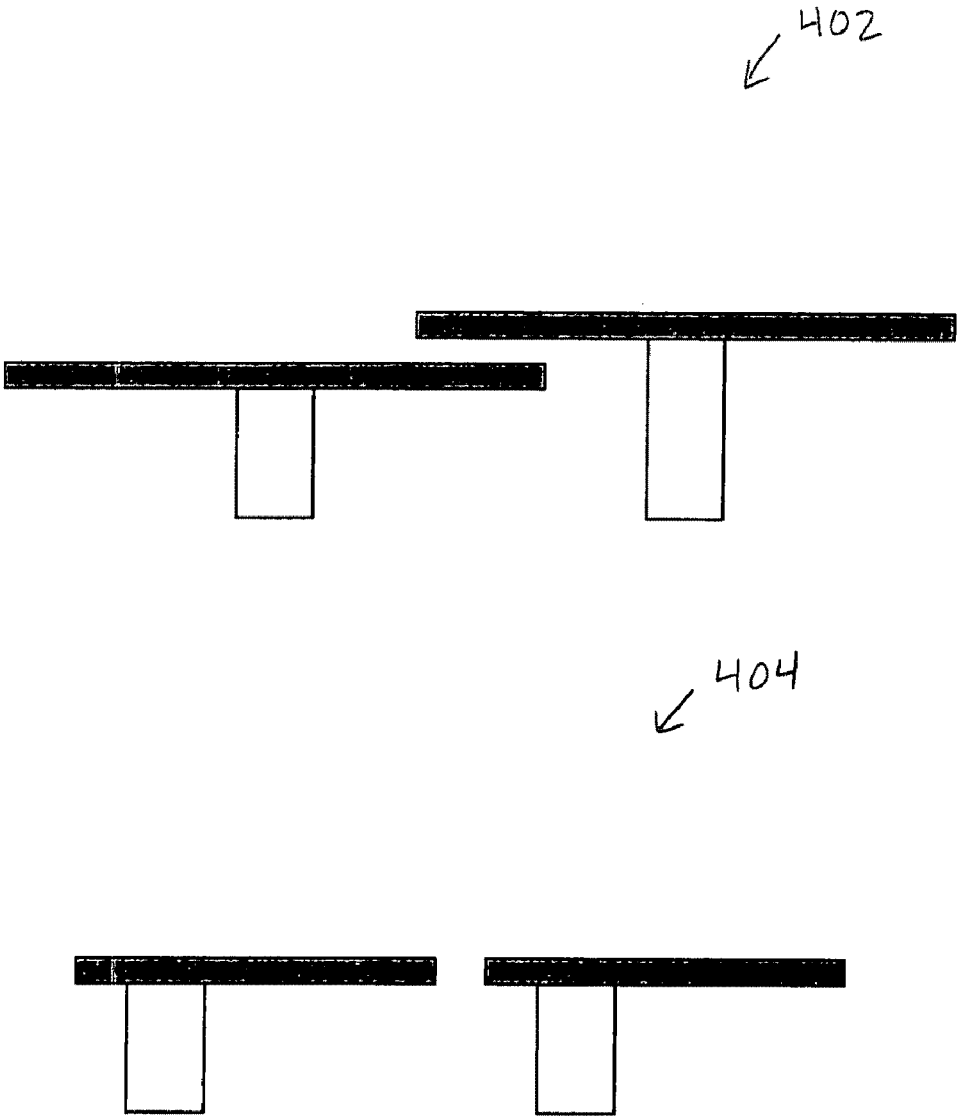
FIG. 4A illustrates examples of paddle installations in a composite display.

When using more than one paddle, there are various ways to ensure that adjacent paddles do not collide with each other. FIG. 4A illustrates examples of paddle installations in a composite display. In these examples, a cross section of adjacent paddles mounted on axes is shown.

In diagram 402, two adjacent paddles rotate in vertically separate sweep planes, ensuring that the paddles will not collide when rotating. This means that the two paddles can rotate at different speeds and do not need to be in phase with each other. To the eye, having the two paddles rotate in different sweep planes is not detectable if the resolution of the display is sufficiently smaller than the vertical spacing between the sweep planes. In this example, the axes are at the center of the paddles. This embodiment is more fully described below.

In diagram 404, the two paddles rotate in the same sweep plane. In this case, the rotation of the paddles is coordinated to avoid collision. For example, the paddles are rotated in phase with each other. Further examples of this are more fully described below.

In the case of the two paddles having different sweep planes, when viewing display area 310 from a point that is not normal to the center of display area 310, light may leak in diagonally between sweep planes. This may occur, for example, if the pixel elements emit unfocused light such that light is emitted at a range of angles. In some embodiments, a mask is used to block light from one sweep plane from being visible in another sweep plane. For example, a mask is placed behind paddle 302 and/or paddle 312. The mask may be attached to paddle 302 and/or 312 or stationary relative to paddle 302 and/or paddle 312. In some embodiments, paddle 302 and/or paddle 312 is shaped differently from that shown in FIGS. 3 and 4A, e.g., for masking purposes. For example, paddle 302 and/or paddle 312 may be shaped to mask the sweep area of the other paddle.

Figure 4B:
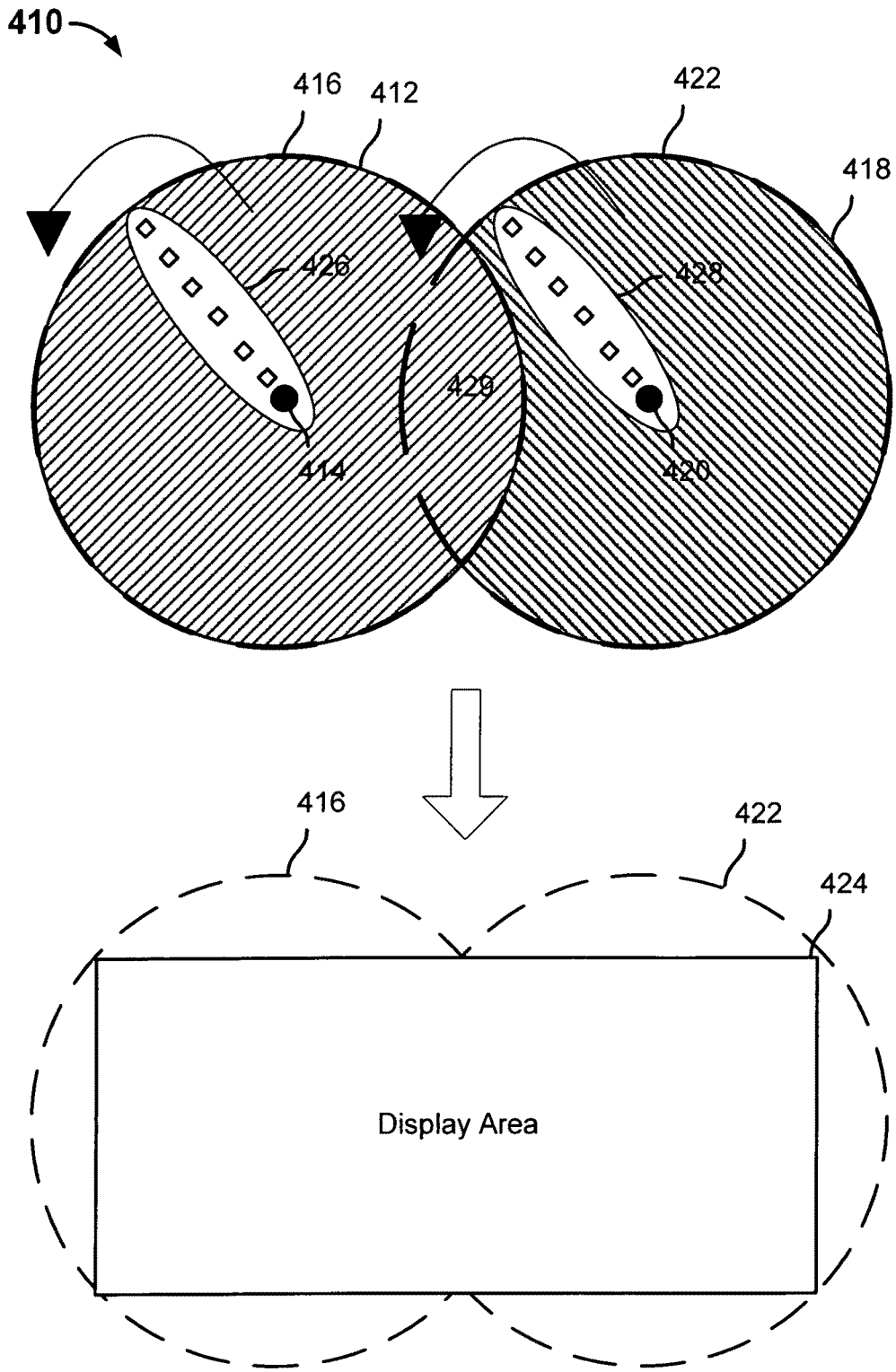
FIG. 4B is a diagram illustrating an embodiment of a composite display 410 that uses masks.

FIG. 4B is a diagram illustrating an embodiment of a composite display 410 that uses masks. In the example shown, paddle 426 is configured to rotate at one end about axis of rotation 414 at a given frequency, such as 60 Hz. A plurality of pixel elements, such as LEDs, is installed on paddle 426. Paddle 426 sweeps out area 416 (bold dashed line) during one rotation or paddle cycle. Paddle 428 is configured to rotate at one end about axis of rotation 420 at a given frequency, such as 60 Hz. Paddle 428 sweeps out area 422 (bold dashed line) during one rotation or paddle cycle. A plurality of pixel elements, such as LEDs, is installed on paddle 428.

In this example, mask 412 (solid line) is used behind paddle 426. In this case, mask 412 is the same shape as area 416 (i.e., a circle). Mask 412 masks light from pixel elements on paddle 428 from leaking into sweep area 416. Mask 412 may be installed behind paddle 426. In some embodiments, mask 412 is attached to paddle 426 and spins around axis of rotation 414 together with paddle 426. In some embodiments, mask 412 is installed behind paddle 426 and is stationary with respect to paddle 426. In this example, mask 418 (solid line) is similarly installed behind paddle 428.

In various embodiments, mask 412 and/or mask 418 may be made out of a variety of materials and have a variety of colors. For example, masks 412 and 418 may be black and made out of plastic.

The display area for showing the image or video may have any shape. The union of swept areas 416 and 422 is the maximum display area. A rectangular image or video may be displayed in rectangular display area 424 as shown.

Areas 416 and 422 overlap. As used herein, two elements (e.g., sweep area, sweep plane, mask, pixel element) overlap if they intersect in an x-y projection. In other words, if the areas are projected onto an x-y plane (defined by the x and y axes, where the x and y axes are in the plane of the figure), they intersect each other. Areas 416 and 422 do not sweep the same plane (do not have the same values of z, where the z axis is normal to the x and y axes), but they overlap each other in overlapping portion 429. In this example, mask 412 occludes sweep area 422 at overlapping portion 429 or occluded area 429. Mask 412 occludes sweep area 429 because it overlaps sweep area 429 and is on top of sweep area 429.

Figure 4C:
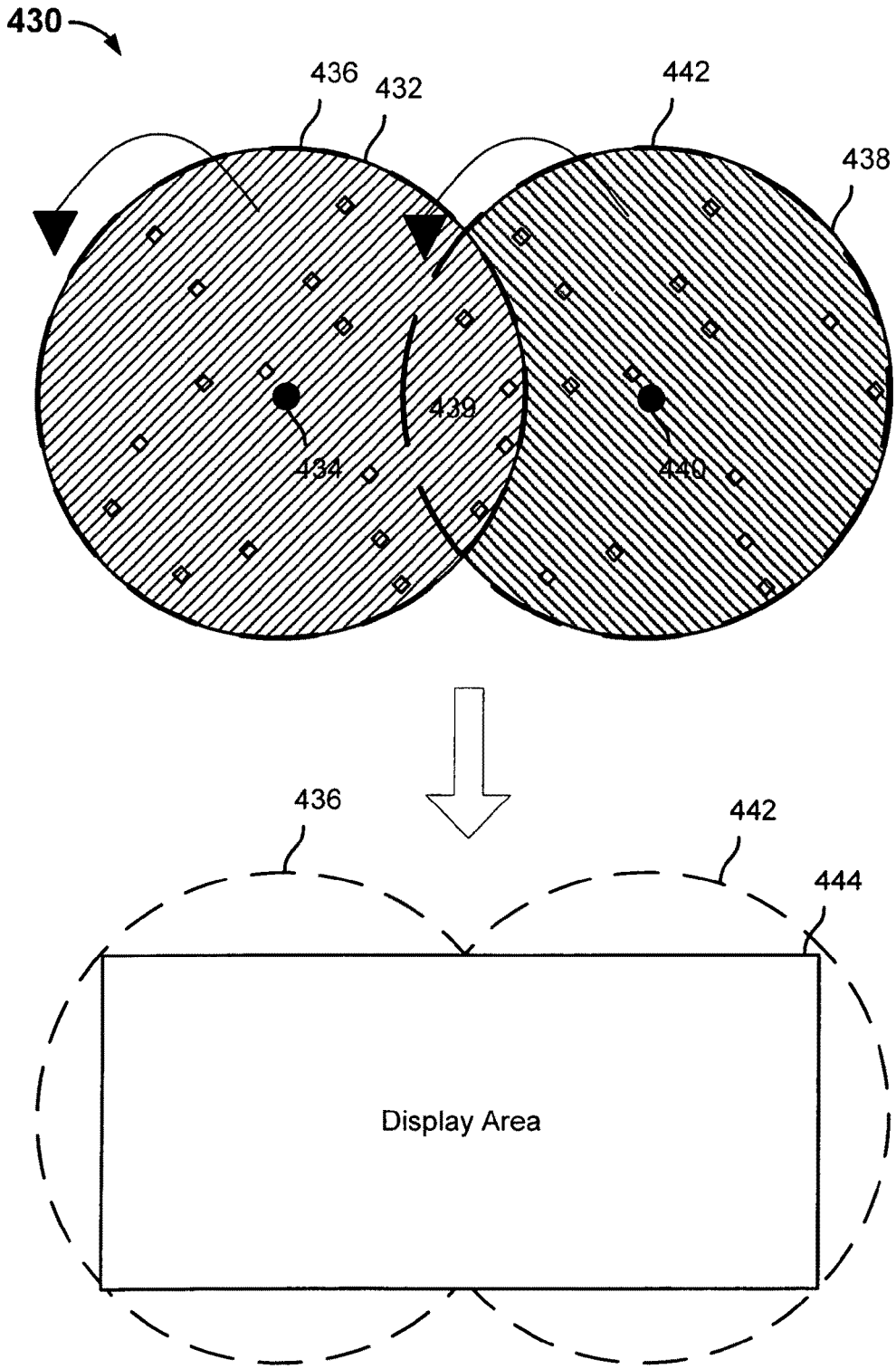
FIG. 4C is a diagram illustrating an embodiment of a composite display 430 that uses masks.

FIG. 4C is a diagram illustrating an embodiment of a composite display 430 that uses masks. In this example, pixel elements are attached to a rotating disc that functions as both a mask and a structure for the pixel elements. Disc 432 can be viewed as a circular shaped paddle. In the example shown, disc 432 (solid line) is configured to rotate at one end about axis of rotation 434 at a given frequency, such as 60 Hz. A plurality of pixel elements, such as LEDs, is installed on disc 432. Disc 432 sweeps out area 436 (bold dashed line) during one rotation or disc cycle. Disc 438 (solid line) is configured to rotate at one end about axis of rotation 440 at a given frequency, such as 60 Hz. Disc 438 sweeps out area 442 (bold dashed line) during one rotation or disc cycle. A plurality of pixel elements, such as LEDs, is installed on disc 438.

In this example, the pixel elements can be installed anywhere on discs 432 and 438. In some embodiments, pixel elements are installed on discs 432 and 438 in the same pattern. In other embodiments, different patterns are used on each disc. In some embodiments, the density of pixel elements is lower towards the center of each disc so the density of temporal pixels is more uniform than if the density of pixel elements is the same throughout the disc. In some embodiments, pixel elements are placed to provide redundancy of temporal pixels (i.e., more than one pixel is placed at the same radius). Having more pixel elements per pixel means that the rotation speed can be reduced. In some embodiments, pixel elements are placed to provide higher resolution of temporal pixels.

Disc 432 masks light from pixel elements on disc 438 from leaking into sweep area 436. In various embodiments, disc 432 and/or disc 438 may be made out of a variety of materials and have a variety of colors. For example, discs 432 and 438 may be black printed circuit board on which LEDs are installed.

The display area for showing the image or video may have any shape. The union of swept areas 436 and 442 is the maximum display area. A rectangular image or video may be displayed in rectangular display area 444 as shown.

Areas 436 and 442 overlap in overlapping portion 439. In this example, disc 432 occludes sweep area 442 at overlapping portion or occluded area 439.

In some embodiments, pixel elements are configured to not be activated when they are occluded. For example, the pixel elements installed on disc 438 are configured to not be activated when they are occluded, (e.g., overlap with occluded area 439). In some embodiments, the pixel elements are configured to not be activated in a portion of an occluded area. For example, an area within a certain distance from the edges of occluded area 439 is configured to not be activated. This may be desirable in case a viewer is to the left or right of the center of the display area and can see edge portions of the occluded area.

Figure 5:
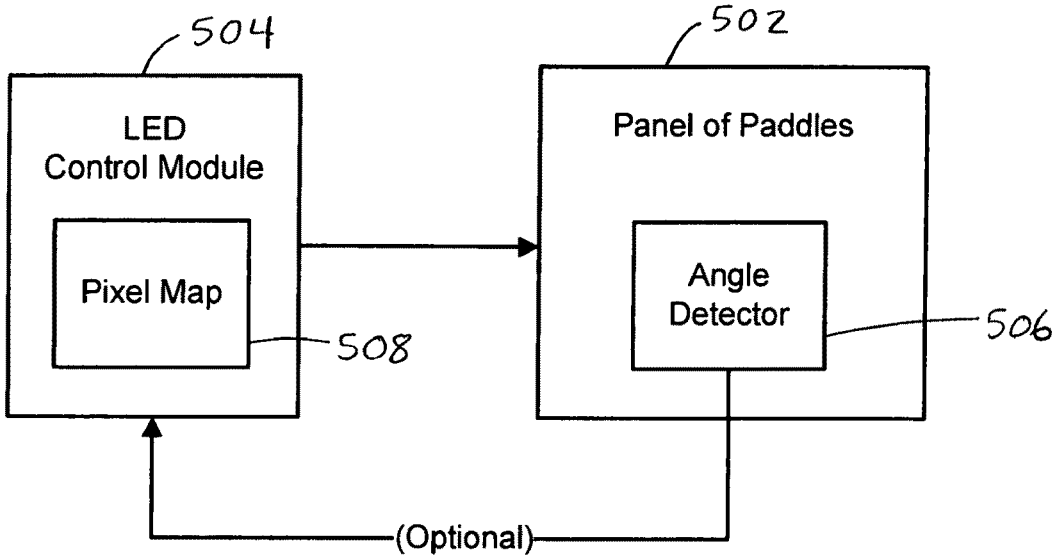
FIG. 5 is a block diagram illustrating an embodiment of a system for displaying an image.

FIG. 5 is a block diagram illustrating an embodiment of a system for displaying an image. In the example shown, panel of paddles 502 is a structure comprising one or more paddles. As more fully described below, panel of paddles 502 may include a plurality of paddles, which may include paddles of various sizes, lengths, and widths; paddles that rotate about a midpoint or an endpoint; paddles that rotate in the same sweep plane or in different sweep planes; paddles that rotate in phase or out of phase with each other; paddles that have multiple arms; and paddles that have other shapes. Panel of paddles 502 may include all identical paddles or a variety of different paddles. The paddles may be arranged in a grid or in any other arrangement. In some embodiments, the panel includes angle detector 506, which is used to detect angles associated with one or more of the paddles. In some embodiments, there is an angle detector for each paddle on panel of paddles 502. For example, an optical detector may be mounted near a paddle to detect its current angle.

LED control module 504 is configured to optionally receive current angle information (e.g., angle(s) or information associated with angle(s)) from angle detector 506. LED control module 504 uses the current angles to determine LED control data to send to panel of paddles 502. The LED control data indicates which LEDs should be activated at that time (sector). In some embodiments, LED control module 504 determines the LED control data using pixel map 508. In some embodiments, LED control module 504 takes an angle as input and outputs which LEDs on a paddle should be activated at that sector for a particular image. In some embodiments, an angle is sent from angle detector 506 to LED control module 504 for each sector (e.g., just prior to the paddle reaching the sector). In some embodiments, LED control data is sent from LED control module 504 to panel of paddles 502 for each sector.

In some embodiments, pixel map 508 is implemented using a lookup table, as more fully described below. For different images, different lookup tables are used. Pixel map 508 is more fully described below.

In some embodiments, there is no need to read an angle using angle detector 506. Because the angular velocity of the paddles and an initial angle of the paddles (at that angular velocity) can be predetermined, it can be computed at what angle a paddle is at any given point in time. In other words, the angle can be determined based on the time. For example, if the angular velocity is $\omega$, the angular location after time t is $\theta_{initial}+\omega t$ where $\theta_{initial}$ is an initial angle once the paddle is spinning at steady state. As such, LED control module can serially output LED control data as a function of time (e.g., using a clock), rather than use angle measurements output from angle detector 506. For example, a table of time (e.g., clock cycles) versus LED control data can be built.

In some embodiments, when a paddle is starting from rest, it goes through a start up sequence to ramp up to the steady state angular velocity. Once it reaches the angular velocity, an initial angle of the paddle is measured in order to compute at what angle the paddle is at any point in time (and determine at what point in the sequence of LED control data to start).

In some embodiments, angle detector 506 is used periodically to provide adjustments as needed. For example, if the angle has drifted, the output stream of LED control data can be shifted. In some embodiments, if the angular speed has drifted, mechanical adjustments are made to adjust the speed.

Figure 6A:
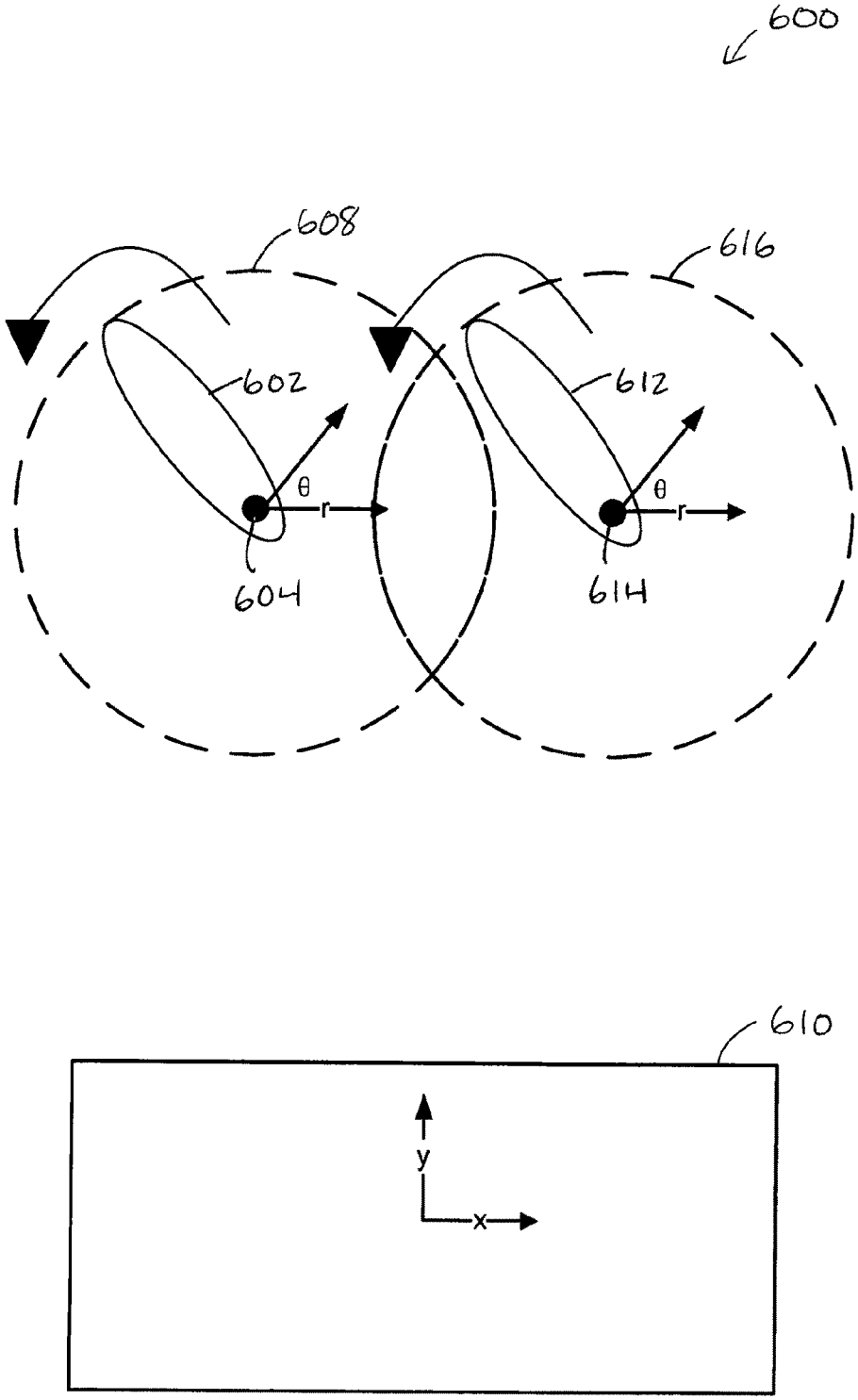
FIG. 6A is a diagram illustrating an embodiment of a composite display 600 having two paddles.

FIG. 6A is a diagram illustrating an embodiment of a composite display 600 having two paddles. In the example shown, a polar coordinate system is indicated over each of areas 608 and 616, with an origin located at each axis of rotation 604 and 614. In some implementations, the position of each LED on paddles 602 and 612 is recorded in polar coordinates. The distance from the origin to the LED is the radius r. The paddle angle is θ. For example, if paddle 602 is in the 3 o'clock position, each of the LEDs on paddle 602 is at 0 degrees. If paddle 602 is in the 12 o'clock position, each of the LEDs on paddle 602 is at 90 degrees. In some embodiments, an angle detector is used to detect the current angle of each paddle. In some embodiments, a temporal pixel is defined by P, r, and θ, where P is a paddle identifier and (r, θ) are the polar coordinates of the LED.

A rectangular coordinate system is indicated over an image 610 to be displayed. In this example, the origin is located at the center of image 610, but it may be located anywhere depending on the implementation. In some embodiments, pixel map 508 is created by mapping each pixel in image 610 to one or more temporal pixels in display area 608 and 616. Mapping may be performed in various ways in various embodiments.

Figure 6B:
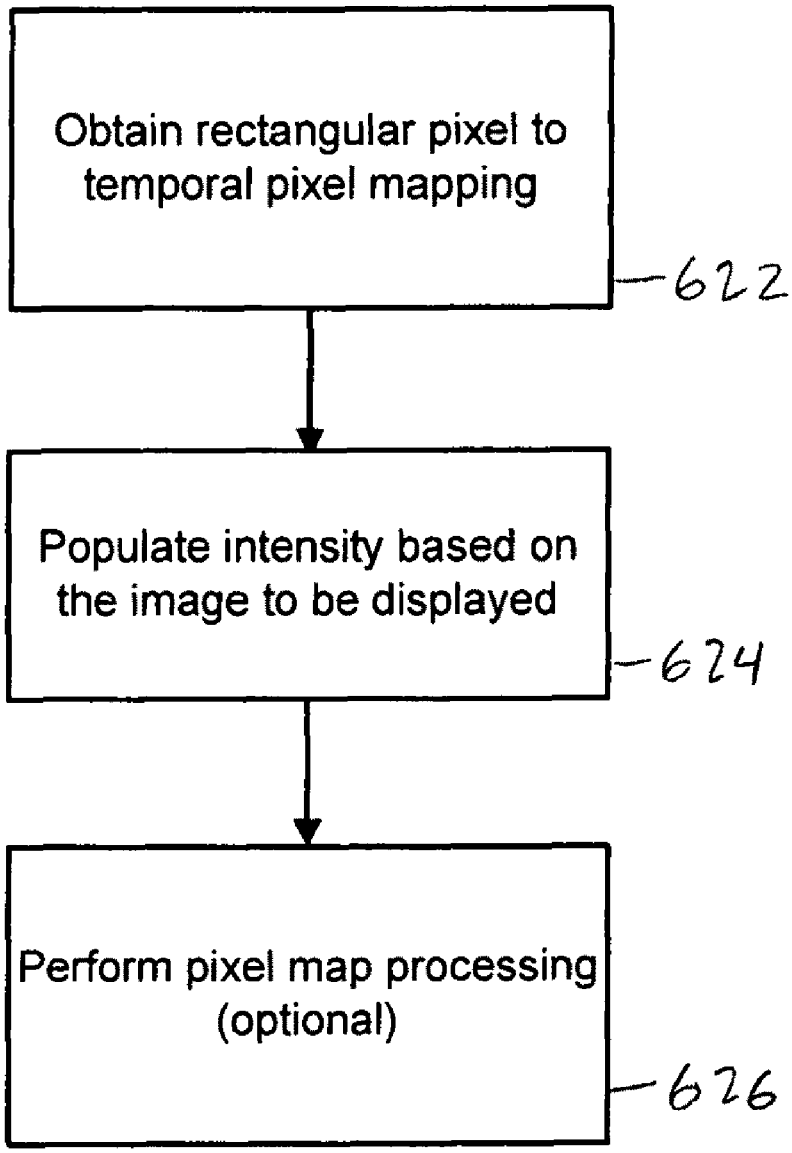
FIG. 6B is a flowchart illustrating an embodiment of a process for generating a pixel map.

FIG. 6B is a flowchart illustrating an embodiment of a process for generating a pixel map. For example, this process may be used to create pixel map 508. At 622, an image pixel to temporal pixel mapping is obtained. In some embodiments, mapping is performed by overlaying image 610 (with its rectangular grid of pixels (x, y) corresponding to the resolution of the image) over areas 608 and 616 (with their two polar grids of temporal pixels (r, θ), e.g., see FIG. 2B). For each image pixel (x, y), it is determined which temporal pixels are within the image pixel. The following is an example of a pixel map:

TABLE 1

| Image pixel (x, y) | Temporal Pixel (P, r, θ) | Intensity (f) |
|---|---|---|
| (a1, a2) | (b1, b2, b3) | |
| (a3, a4) | (b4, b5, b6); (b7, b8, b9) | |
| (a5, a6) | (b10, b11, b12) | |
| etc. | etc. | |

As previously stated, one image pixel may map to multiple temporal pixels as indicated by the second row. In some embodiments, instead of r, an index corresponding to the LED is used. In some embodiments, the image pixel to temporal pixel mapping is precomputed for a variety of image sizes and resolutions (e.g., that are commonly used).

At 624, an intensity f is populated for each image pixel based on the image to be displayed. In some embodiments, f indicates whether the LED should be on (e.g., 1) or off (e.g., 0). For example, in a black and white image (with no grayscale), black pixels map to f=1 and white pixels map to f=0. In some embodiments, f may have fractional values. In some embodiments, f is implemented using duty cycle management. For example, when f is 0, the LED is not activated for that sector time. When f is 1, the LED is activated for the whole sector time. When f is 0.5, the LED is activated for half the sector time. In some embodiments, f can be used to display grayscale images. For example, if there are 256 gray levels in the image, pixels with gray level 128 (half luminance) would have f=0.5. In some embodiments, rather than implement f using duty cycle (i.e., pulse width modulated), f is implemented by adjusting the current to the LED (i.e., pulse height modulation).

For example, after the intensity f is populated, the table may appear as follows:

TABLE 2

| Image pixel (x, y) | Temporal Pixel (P, r, θ) | Intensity (f) |
|---|---|---|
| (a1, a2) | (b1, b2, b3) | f1 |
| (a3, a4) | (b4, b5, b6); (b7, b8, b9) | f2 |
| (a5, a6) | (b10, b11, b12) | f3 |
| etc. | etc. | etc. |

At 626, optional pixel map processing is performed. This may include compensating for overlap areas, balancing luminance in the center (i.e., where there is a higher density of temporal pixels), balancing usage of LEDs, etc. For example, when LEDs are in an overlap area (and/or on a boundary of an overlap area), their duty cycle may be reduced. For example, in composite display 300, when LEDs are in overlap area 318, their duty cycle is halved. In some embodiments, there are multiple LEDs in a sector time that correspond to a single image pixel, in which case, fewer than all the LEDs may be activated (i.e., some of the duty cycles may be set to 0). In some embodiments, the LEDs may take turns being activated (e.g., every N cycles where N is an integer), e.g., to balance usage so that one doesn't burn out earlier than the others. In some embodiments, the closer the LEDs are to the center (where there is a higher density of temporal pixels), the lower their duty cycle.

For example, after luminance balancing, the pixel map may appear as follows:

TABLE 3

| Image pixel (x, y) | Temporal Pixel (P, r, θ) | Intensity (f) |
|---|---|---|
| (a1, a2) | (b1, b2, b3) | f1 |
| (a3, a4) | (b4, b5, b6) | f2 |
| (a5, a6) | (b10, b11, b12) | f3 |
| etc. | etc. | etc. |

As shown, in the second row, the second temporal pixel was deleted in order to balance luminance across the pixels. This also could have been accomplished by halving the intensity to f2/2. As another alternative, temporal pixel (b4, b5, b6) and (b7, b8, b9) could alternately turn on between cycles. In some embodiments, this can be indicated in the pixel map. The pixel map can be implemented in a variety of ways using a variety of data structures in different implementations.

For example, in FIG. 5, LED control module 504 uses the temporal pixel information (P, r, θ, and f) from the pixel map. LED control module 504 takes θ as input and outputs LED control data P, r, and f. Panel of paddles 502 uses the LED control data to activate the LEDs for that sector time. In some embodiments, there is an LED driver for each paddle that uses the LED control data to determine which LEDs to turn on, if any, for each sector time.

Any image (including video) data may be input to LED control module 504. In various embodiments, one or more of 622, 624, and 626 may be computed live or in real time, i.e., just prior to displaying the image. This may be useful for live broadcast of images, such as a live video of a stadium. For example, in some embodiments, 622 is precomputed and 624 is computed live or in real time. In some implementations, 626 may be performed prior to 622 by appropriately modifying the pixel map. In some embodiments, 622, 624, and 626 are all precomputed. For example, advertising images may be precomputed since they are usually known in advance.

The process of FIG. 6B may be performed in a variety of ways in a variety of embodiments. Another example of how 622 may be performed is as follows. For each image pixel (x, y), a polar coordinate is computed. For example, (the center of) the image pixel is converted to polar coordinates for the sweep areas it overlaps with (there may be multiple sets of polar coordinates if the image pixel overlaps with an overlapping sweep area). The computed polar coordinate is rounded to the nearest temporal pixel. For example, the temporal pixel whose center is closest to the computed polar coordinate is selected. (If there are multiple sets of polar coordinates, the temporal pixel whose center is closest to the computed polar coordinate is selected.) This way, each image pixel maps to at most one temporal pixel. This may be desirable because it maintains a uniform density of activated temporal pixels in the display area (i.e., the density of activated temporal pixels near an axis of rotation is not higher than at the edges). For example, instead of the pixel map shown in Table 1, the following pixel map may be obtained:

TABLE 4

| Image pixel (x, y) | Temporal Pixel (P, r, θ) | Intensity (f) |
|---|---|---|
| (a1, a2) | (b1, b2, b3) | |
| (a3, a4) | (b7, b8, b9) | |
| (a5, a6) | (b10, b11, b12) | |
| etc. | etc. | |

In some cases, using this rounding technique, two image pixels may map to the same temporal pixel. In this case, a variety of techniques may be used at 626, including, for example: averaging the intensity of the two rectangular pixels and assigning the average to the one temporal pixel; alternating between the first and second rectangular pixel intensities between cycles; remapping one of the image pixel to a nearest neighbor temporal pixel; etc.

Figure 7:
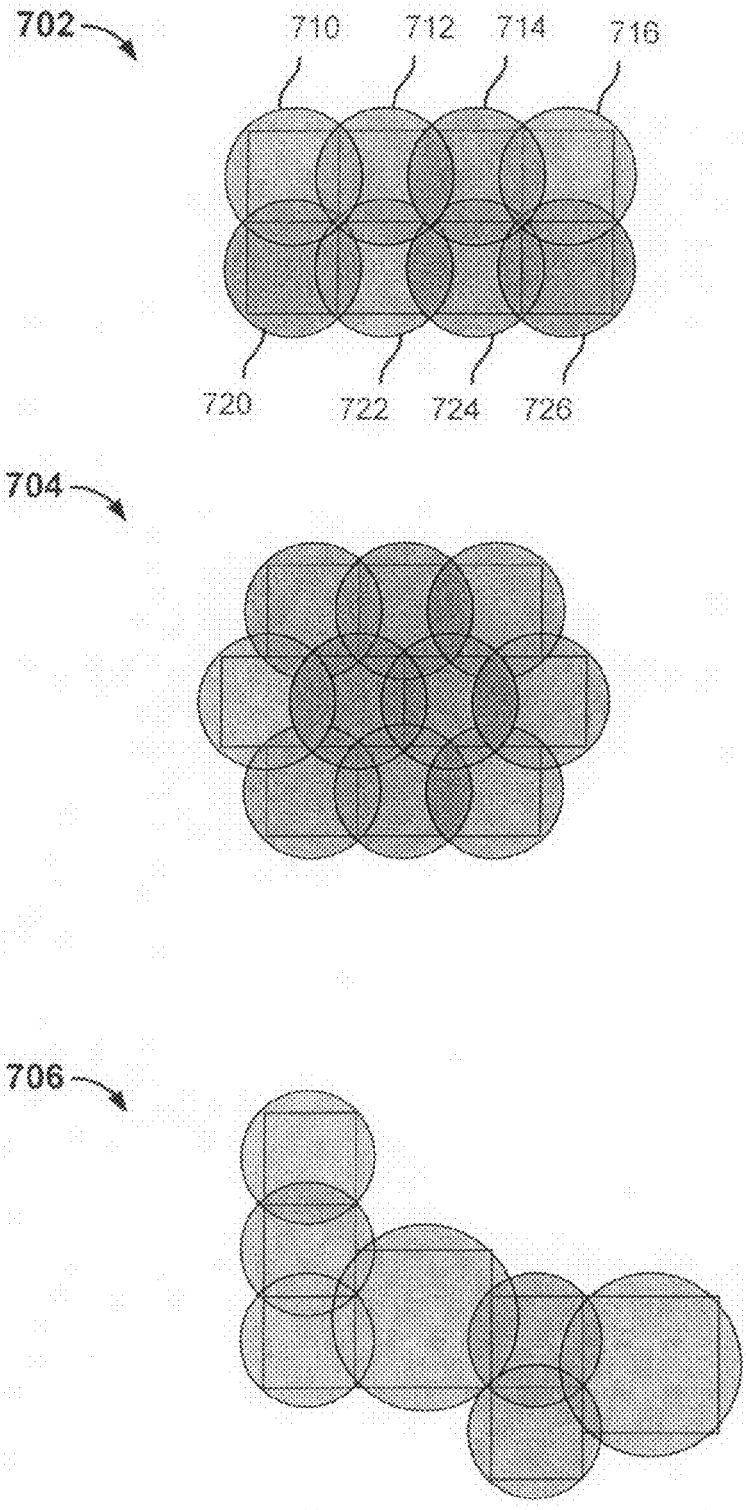
FIG. 7 illustrates examples of paddles arranged in various arrays.

FIG. 7 illustrates examples of paddles arranged in various arrays. For example, any of these arrays may comprise panel of paddles 502. Any number of paddles may be combined in an array to create a display area of any size and shape.

Arrangement 702 shows eight circular sweep areas corresponding to eight paddles each with the same size. The sweep areas overlap as shown. In addition, rectangular display areas are shown over each sweep area. For example, the maximum rectangular display area for this arrangement would comprise the union of all the rectangular display areas shown. To avoid having a gap in the maximum display area, the maximum spacing between axes of rotation is $\sqrt{2}R$, where R is the radius of one of the circular sweep areas. The spacing between axes is such that the periphery of one sweep area does not overlap with any axes of rotation, otherwise there would be interference. Any combination of the sweep areas and rectangular display areas may be used to display one or more images.

In some embodiments, the eight paddles are in the same sweep plane. In some embodiments, the eight paddles are in different sweep planes. It may be desirable to minimize the number of sweep planes used. For example, it is possible to have every other paddle sweep the same sweep plane. For example, sweep areas 710, 714, 722, and 726 can be in the same sweep plane, and sweep areas 712, 716, 720, and 724 can be in another sweep plane.

In some configurations, sweep areas (e.g., sweep areas 710 and 722) overlap each other. In some configurations, sweep areas are tangent to each other (e.g., sweep areas 710 and 722 can be moved apart so that they touch at only one point). In some configurations, sweep areas do not overlap each other (e.g., sweep areas 710 and 722 have a small gap between them), which is acceptable if the desired resolution of the display is sufficiently low.

Arrangement 704 shows ten circular sweep areas corresponding to ten paddles. The sweep areas overlap as shown. In addition, rectangular display areas are shown over each sweep area. For example, three rectangular display areas, one in each row of sweep areas, may be used, for example, to display three separate advertising images. Any combination of the sweep areas and rectangular display areas may be used to display one or more images.

Arrangement 706 shows seven circular sweep areas corresponding to seven paddles. The sweep areas overlap as shown. In addition, rectangular display areas are shown over each sweep area. In this example, the paddles have various sizes so that the sweep areas have different sizes. Any combination of the sweep areas and rectangular display areas may be used to display one or more images. For example, all the sweep areas may be used as one display area for a non-rectangular shaped image, such as a cut out of a giant serpent.

Figure 8:
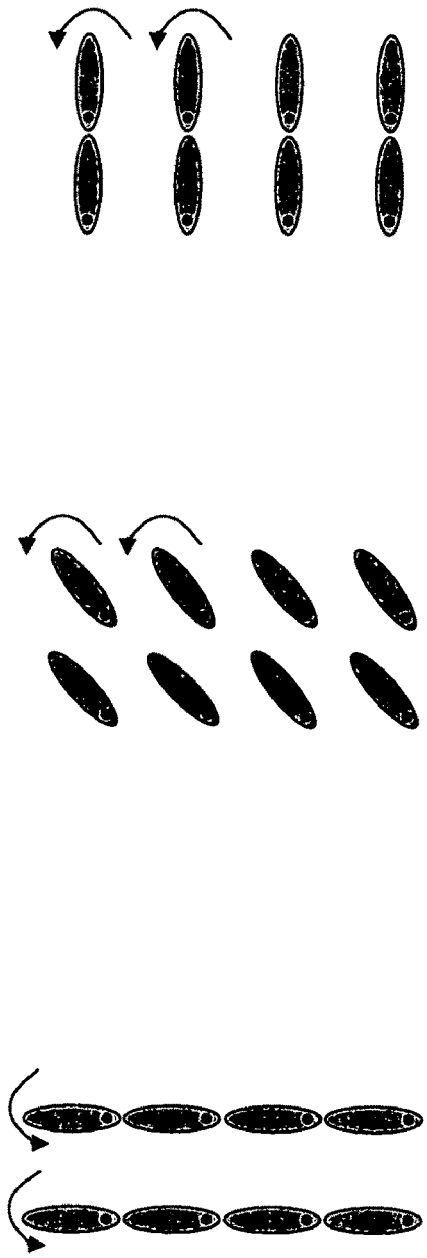
FIG. 8 illustrates examples of paddles with coordinated in phase motion to prevent mechanical interference.

FIG. 8 illustrates examples of paddles with coordinated in phase motion to prevent mechanical interference. In this example, an array of eight paddles is shown at three points in time. The eight paddles are configured to move in phase with each other; that is, at each point in time, each paddle is oriented in the same direction (or is associated with the same angle when using the polar coordinate system described in FIG. 6A).

Figure 9:
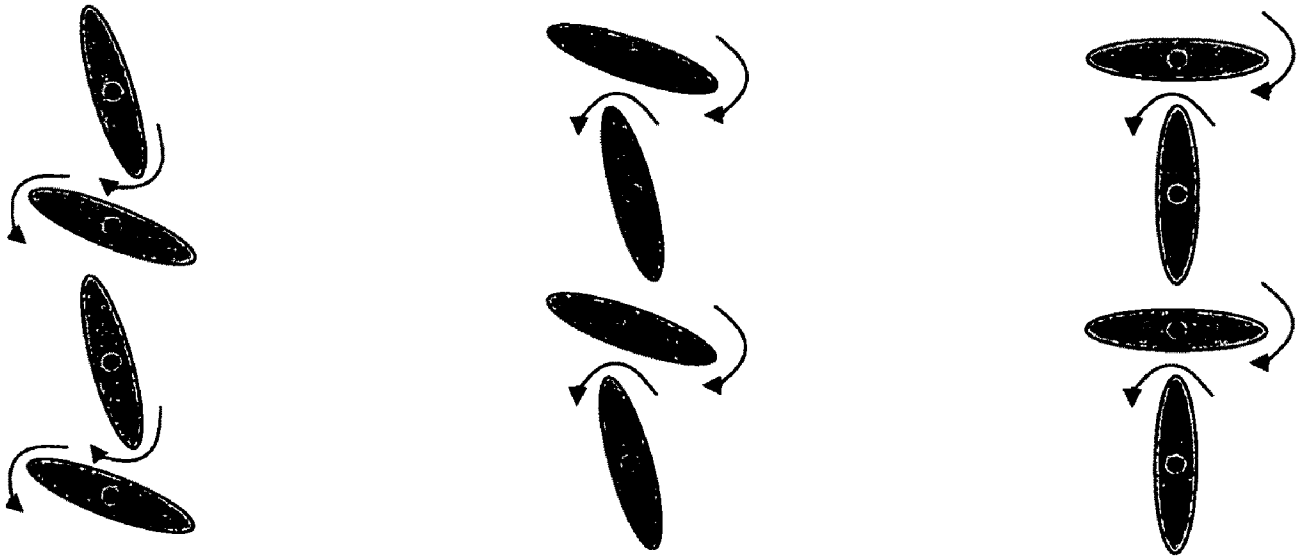
FIG. 9 illustrating examples of paddles with coordinated out of phase motion to prevent mechanical interference.

FIG. 9 illustrating examples of paddles with coordinated out of phase motion to prevent mechanical interference. In this example, an array of four paddles is shown at three points in time. The four paddles are configured to move out of phase with each other; that is, at each point in time, at least one paddle is not oriented in the same direction (or is associated with the same angle when using the polar coordinate system described in FIG. 6A) as the other paddles. In this case, even though the paddles move out of phase with each other, their phase difference (difference in angles) is such that they do not mechanically interfere with each other.

The display systems described herein have a naturally built in cooling system. Because the paddles are spinning, heat is naturally drawn off of the paddles. The farther the LED is from the axis of rotation, the more cooling it receives. In some embodiments, this type of cooling is at least 10× effective as systems in which LED tiles are stationary and in which an external cooling system is used to blow air over the LED tiles using a fan. In addition, a significant cost savings is realized by not using an external cooling system.

Although in the examples herein, the image to be displayed is provided in pixels associated with rectangular coordinates and the display area is associated with temporal pixels described in polar coordinates, the techniques herein can be used with any coordinate system for either the image or the display area.

Although rotational movement of paddles is described herein, any other type of movement of paddles may also be used. For example, a paddle may be configured to move from side to side (producing a rectangular sweep area, assuming the LEDs are aligned in a straight row). A paddle may be configured to rotate and simultaneously move side to side (producing an elliptical sweep area). A paddle may have arms that are configured to extend and retract at certain angles, e.g., to produce a more rectangular sweep area. Because the movement is known, a pixel map can be determined, and the techniques described herein can be applied.

Figure 10:
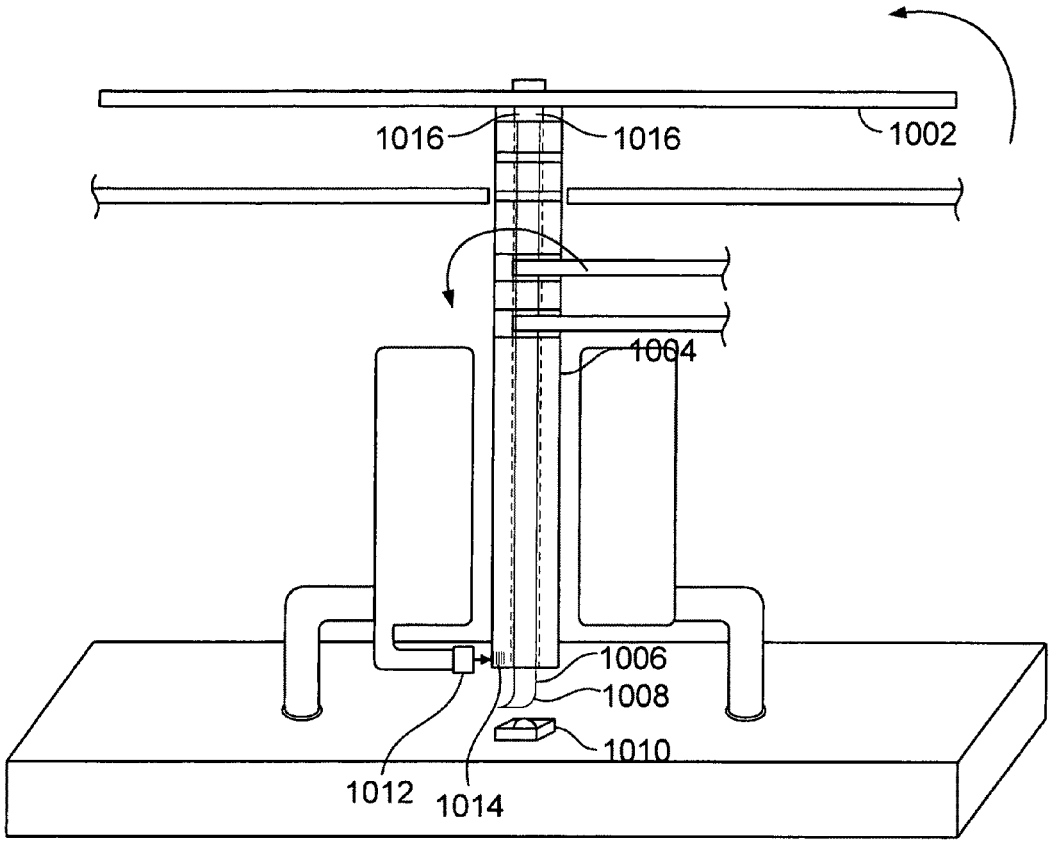
FIG. 10 is a diagram illustrating an example of a cross section of a paddle in a composite display.

FIG. 10 is a diagram illustrating an example of a cross section of a paddle in a composite display. This example is shown to include paddle 1002, shaft 1004, optical fiber 1006, optical camera 1012, and optical data transmitter 1010. Paddle 1002 is attached to shaft 1004. Shaft 1004 is bored out (i.e., hollow) and optical fiber 1006 runs through its center. The base 1008 of optical fiber 1006 receives data via optical data transmitter 1010. The data is transmitted up optical fiber 1006 and transmitted at 1016 to an optical detector (not shown) on paddle 1002. The optical detector provides the data to one or more LED drivers used to activate one or more LEDs on paddle 1002. In some embodiments, LED control data that is received from LED control module 504 is transmitted to the LED driver in this way.

In some embodiments, the base of shaft 1004 has appropriate markings 1014 that are read by optical camera 1012 to determine the current angular position of paddle 1002. In some embodiments, optical camera 1012 is used in conjunction with angle detector 506 to output angle information that is fed to LED control module 508 as shown in FIG. 5.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A composite display including:

a first paddle having a first plurality of pixel elements wherein the first paddle is arranged to rotate around a first axis and sweep out a first area during a first paddle cycle;

a second paddle having a second plurality of pixel elements wherein the second paddle is arranged to rotate around a second axis and sweep out a second area during a second paddle cycle, wherein the first axis is substantially parallel to the second axis and substantially perpendicular to a composite display area, and wherein the first and second areas include an overlapping portion and first and second non-overlapping portions;

a first pixel element on the first paddle configured to be activated when the first pixel element coincides with a first image pixel; and a second pixel element on the second paddle configured to be activated when the second pixel element coincides with a second image pixel;

wherein an image corresponding to the first and second image pixels is represented in the composite display area by activating the first and second pixel elements.

2. The display of claim 1, wherein the first image pixel corresponds to the first non-overlapping portion in the first area.

3. The display of claim 1, wherein the overlapping portion of the first and second areas overlaps in an x-y projection.

4. The display of claim 3, wherein the first image pixel corresponds to the overlapping portion in the first area.

5. The display of claim 1, wherein at least one of the first pixel element and the second pixel element is a light emitting diode (LED).

6. The display of claim 1, wherein activating includes activating the first pixel element over a specified duty cycle.

7. The display of claim 1, wherein the first image pixel is mapped to a first temporal pixel associated with the first pixel element, such that the first pixel element coincides with the first image pixel.

8. The display of claim 7, wherein the first temporal pixel includes a first pixel element on the first paddle and a first time in a first paddle cycle.

9. The display of claim 7, wherein the first temporal pixel includes a first pixel element on the first paddle and a first angle in a first paddle cycle.

10. The display of claim 7, wherein the first temporal pixel is mapped to an intensity value.

11. The display of claim 1, wherein the first image pixel is mapped to a first temporal pixel and a second temporal pixel.

12. The display of claim 1, wherein the first image pixel is mapped to a first temporal pixel and a second temporal pixel wherein a pixel element associated with the first temporal pixel is sometimes activated and a pixel element associated with the second temporal pixel is sometimes activated.

13. The display of claim 1, wherein at least one of the first and second paddles is configured to rotate about an axis of rotation.

14. The display of claim 1, wherein the first and second paddles are each configured sweep in phase with each other.

15. The display of claim 1, wherein the first and second paddles are each configured to sweep out of phase with each other.

16. The display of claim 1, wherein the first and second paddles are arranged to sweep in different sweep planes.

17. The display of claim 1, wherein the first and the second paddles have different sizes.

18. The display of claim 1, wherein at least one of the first and second paddles is configured to start from rest by ramping up from an initial speed to a final speed.

19. The display of claim 1, wherein control data for at least one of the first and second pixel elements is provided according to a clock.

20. The display of claim 1, wherein the first and second pixel elements are activated based on data received via at least one optical fiber.

21. The display of claim 1, wherein the first image pixel is mapped to a first temporal pixel that is closest to the first image pixel.

22. The display of claim 1, wherein the overlapping portion of the first and second areas overlaps in an x-y projection and wherein a mask is configured to occlude the overlapping portion.

23. The display of claim 1, wherein the overlapping portion of the first and second areas overlaps in an x-y projection and wherein at least one of the first and second paddles is shaped such that it occludes the overlapping portion.

24. The composite display of claim 1, further comprising a control module for activating pixel elements relatively less frequently when the pixel elements are in the overlapping portion and relatively more frequently when the pixel elements are in the first non-overlapping portion or the second non-overlapping portion.

25. A method, comprising:

rotating a first paddle having a first plurality of pixel elements around a first axis to sweep out a first area during a first paddle cycle;

rotating a second paddle having a second plurality of pixel elements around a second axis to sweep out a second area during a second paddle cycle, wherein the first axis is substantially parallel to the second axis and substantially perpendicular to a composite display area, and wherein the first and second areas include an overlapping portion and first and second non-overlapping portions;

activating a first pixel element on the first paddle when the first pixel element coincides with a first image pixel; and activating a second pixel element on the second paddle when the second pixel element coincides with a second image pixel;

wherein an image corresponding to the first and second image pixels is represented in the composite display by activating the first and second pixel elements.

26. The method of claim 25, wherein the first image pixel corresponds to the first non-overlapping portion in the first area.

27. The method of claim 25, wherein the first image pixel corresponds to the overlapping portion in the first area.

28. The method of claim 25, wherein the first image pixel is mapped to a first temporal pixel associated with the first pixel element, such that the first pixel element coincides with the first image pixel.

29. The method of claim 28, wherein the first temporal pixel includes a first pixel element on the first paddle and a first time in a first paddle cycle.

30. The method of claim 25, further comprising activating pixel elements relatively less frequently when the pixel elements are in the overlapping portion and relatively more frequently when the pixel elements are in the first non-overlapping portion or the second non-overlapping portion.

31. An apparatus, comprising:

means for rotating a first paddle having a first plurality of pixel elements around a first axis to sweep out a first area during a first paddle cycle;

means for rotating a second paddle having a second plurality of pixel elements around a second axis to sweep out a second area during a second paddle cycle, wherein the first axis is substantially parallel to the second axis and substantially perpendicular to a composite display area, and wherein the first and second areas include an overlapping portion and first and second non-overlapping portions; and control means for representing an image corresponding to the first and second image pixels in the composite display by activating a first pixel element on the first paddle when the first pixel element coincides with a first image pixel and activating a second pixel element on the second paddle when the second pixel element coincides with a second image pixel.

32. The apparatus of claim 31, wherein the first image pixel corresponds to the first non-overlapping portion in the first area.

33. The apparatus of claim 31, wherein the first image pixel corresponds to the overlapping portion in the first area.

34. The apparatus of claim 31, wherein the control means is further configured to map a first image pixel to a first temporal pixel associated with the first pixel element, such that the first pixel element coincides with the first image pixel.

35. The apparatus of claim 34, wherein the first temporal pixel includes a first pixel element on the first paddle and a first time in a first paddle cycle.

36. The apparatus of claim 31, wherein the control means is configured for activating pixel elements relatively less frequently when the pixel elements are in the overlapping portion and relatively more frequently when the pixel elements are in the first non-overlapping portion or the second non-overlapping portion.

* * * * *